US008208844B2

(12) United States Patent
Omata et al.

(10) Patent No.: US 8,208,844 B2
(45) Date of Patent: Jun. 26, 2012

(54) ROLLER FOR FIXING AND IMAGE FIXING APPARATUS USING ROLLER FOR FIXING

(75) Inventors: Masahito Omata, Mishima (JP); Shoji Umehara, Moriya (JP); Kazuo Kishino, Yokohama (JP); Katsuhisa Matsunaka, Inagi (JP); Yoji Tomoyuki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 501 days.

(21) Appl. No.: 12/437,913

(22) Filed: May 8, 2009

(65) Prior Publication Data

US 2009/0285611 A1 Nov. 19, 2009

(30) Foreign Application Priority Data

May 13, 2008 (JP) ..... 2008-125488

(51) Int. Cl.
*G03G 15/20* (2006.01)

(52) U.S. Cl. ..... 399/333; 399/320

(58) Field of Classification Search ..... 399/333, 399/320
See application file for complete search history.

(56) References Cited

U.S. PATENT DOCUMENTS 6,989,182 B2 * 1/2006 Chen et al. ..... 428/36.8
2007/0217837 A1 * 9/2007 Yamana et al. ..... 399/328
2008/0199233 A1 8/2008 Matsunaka et al. ..... 399/336
2009/0129797 A1 * 5/2009 Suzuki et al. ..... 399/44

FOREIGN PATENT DOCUMENTS

JP 61-184574 8/1986
JP 10-115991 5/1998
JP 2001-228736 8/2001

* cited by examiner

*Primary Examiner* — David Gray
*Assistant Examiner* — Roy Y Yi
(74) *Attorney, Agent, or Firm* — Fitzpatrick, Cella, Harper & Scinto

(57) ABSTRACT

A fixing roller of an image fixing apparatus has an elastic layer on a core metal and has a thermal conductive fluororubber latex layer containing a mixture of fluororubber, fluororesin and thermal conductive fillers more outer side than the elastic. An intermediate layer made of silicone rubber having higher thermal conductivity than the thermal conductive fluororubber latex layer is provided between the thermal conductive fluororubber latex layer and the elastic layer, and the intermediate layer is configured so that an elastic parameter Y(=H×T) satisfies a relational expression:

$$Y \geqq 4200$$

where H (degree) is Asker-C hardness of the silicone rubber having higher thermal conductivity (500 g load) and T (μm) is a thickness of the silicone rubber having higher thermal conductivity.

12 Claims, 6 Drawing Sheets

ROLLER FOR FIXING AND IMAGE FIXING APPARATUS USING ROLLER FOR FIXING

BACKGROUND OF THE INVENTION

1. Field of the Invention

The present invention relates to a roller for fixing used in an image fixing apparatus included in an image forming apparatus such as an electrophotographic copying machine or an electrophotographic printer, and an image fixing apparatus using the roller for fixing.

2. Description of the Related Art

Electrophotographic copying machines and electrophotographic printers include an image fixing apparatus for heating and fixing, on a recording material, an unfixed toner image carried by the recording material.

A roller for fixing such as a fixing roller or a pressure roller included in an image fixing apparatus needs a releasing layer for preventing adhesion of toner. A method of providing a releasing layer includes a method of covering a surface of a roller for fixing with tube-shaped fluororesin, or a method of coating a surface of a roller for fixing with a liquid containing dispersed fluororesin powder, and then melting the fluororesin by calcining to form a releasing layer of fluororesin.

There is a roller for fixing desirably having a layer configuration including a thermal insulation layer having a high thermal insulation property inside, and a thermal storage layer having a high volume heat capacity near a surface. An example thereof is a roller for fixing suitable for a fixing apparatus in which a heat source is not provided inside the roller for fixing, but a surface of the roller for fixing is heated from outside the roller for fixing to store heat near the surface, and the heat is provided to a toner image on a recording material in a fixing nip portion. Another example is a pressure roller suitable for a film heating type fixing apparatus, including an endless film, a heater that comes into contact with an inner surface of the endless film, and a pressure roller that forms a fixing nip portion with the heater via the endless film. A surface of the pressure roller as a roller for fixing is formed as a thermal storage layer (having high thermal conductivity) to allow heat on the surface of the pressure roller to be stored and transferred, and thus a fixing temperature and electric power can be reduced.

When a releasing layer is formed of tube-shaped fluororesin in such a roller for fixing, the tube-shaped fluororesin has a thickness of about 30 μm, and this prevents heat supplied from outside the roller for fixing from being transferred to the thermal storage layer. Meanwhile, with a method of coating with a liquid containing dispersed fluororesin powder, a thickness of a releasing layer can be reduced. However, a thermal insulation layer significantly expands in a process of calcining the liquid coated on the surface of the roller for fixing, and the expansion affects the liquid containing dispersed fluororesin via the thermal storage layer. When the thermal insulation layer expands, the coated fluororesin powder in the liquid is dissociated before melted, and even if the fluororesin powder is melted by calcining, the fluororesin layer is separated. Then, even if the thermal insulation layer is cooled and shrinks after the calcining, the fluororesin layer remains separated (cracked) or wrinkled. The fluororesin layer separated or wrinkled does not function as a releasing layer.

As a method of forming a thin releasing layer with reduced cracks, a method of coating fluororubber latex on a thermal storage layer is supposed. The fluororubber latex, generally in a dispersion state, is applied to a surface of a roller for fixing, and calcined at a temperature of about 300° C. Components of the fluororubber latex include fluororesin, and the fluororesin seeps out to the surface of the roller for fixing by calcining to form a releasing layer. Thus, the fluororubber latex is separated into a fluororubber layer and a fluororesin layer in the calcining process. The fluororubber latex has rubber elasticity (stretchability), and thus even if a thermal insulation layer thermally expands in the calcining process, a thin fluororesin releasing layer with reduced cracks or wrinkles can be formed. Japanese Patent Application Laid-Open No. H10-115991 discloses a pressure roller including, on a core metal, a thermal insulation layer of sponge, a high thermal conductive silicone rubber layer, and a fluororubber latex layer.

To store heat in a thermal storage layer, thermal conductivity of a fluororubber latex layer needs to be also increased. To increase the thermal conductivity of a fluororubber latex coat, high thermal conductive filler needs to be dispersed therein. To obtain at least an effect of increasing thermal conductivity of the fluororubber latex coat, a volume fraction of the high thermal conductive filler in the fluororubber latex coat needs to be about 5% or more. However, the fluororubber latex layer containing the dispersed high thermal conductive filler eventually has low rubber elasticity. This reduces a function of the fluororubber latex of preventing cracks or wrinkles in a releasing layer, and causes wrinkles to easily occur on the surface during production.

SUMMARY OF THE INVENTION

The present invention is achieved in view of the above described problems, and provides a roller for fixing that can prevent wrinkles from occurring on a surface of the roller during production, and an image fixing apparatus using the roller for fixing.

The present invention provides a roller for fixing including: a core metal; an elastic layer; a fluororubber latex layer; and an intermediate layer provided between the elastic layer and the fluororubber latex layer and having thermal conductivity higher than thermal conductivity of the elastic layer, wherein the fluororubber latex layer includes fillers for increasing thermal conductivity, and an elastic parameter $Y(=H\times T)$ satisfies a relational expression: $Y\geqq 4200$ where H (degree) is Asker-C hardness of the intermediate layer (500 g load) and T (μm) is a thickness of the intermediate layer.

The present invention further provides an image fixing apparatus including: a roller for fixing including a core metal, an elastic layer, a fluororubber latex layer, and an intermediate layer which is provided between the elastic layer and the fluororubber latex layer and which has thermal conductivity higher than thermal conductivity of the elastic layer; a heater for heating the roller for fixing from outside; a backup member for forming, with the roller for fixing, a fixing nip portion for pinching and conveying a recording material, wherein the fluororubber latex layer includes fillers for increasing thermal conductivity, and an elastic parameter $Y(=H\times T)$ satisfies a relational expression: $Y\geqq 4200$, where H (degree) is Asker-C hardness of the intermediate layer (500 g load) and T (μm) is a thickness of the intermediate layer.

The present invention further provides an image fixing apparatus including: an endless belt; a heater that comes into contact with an inner surface of the endless belt; a roller for fixing for forming, with the heater, a fixing nip portion which pinches and conveys the recording material via the endless belt, the roller for fixing including a core metal, an elastic layer, a fluororubber latex layer, and an intermediate layer which is provided between the elastic layer and the fluororubber latex layer and which has thermal conductivity higher than thermal conductivity of the elastic layer, wherein the fluororubber latex layer includes filler for increasing thermal conductivity, and an elastic parameter Y(=H×T) satisfies a relational expression: Y≧4200: where H (degree) is Asker-C hardness of the intermediate layer (500 g load) and T (μm) is a thickness of the intermediate layer.

Further features of the present invention will become apparent from the following description of exemplary embodiments with reference to the attached drawings.

DESCRIPTION OF THE EMBODIMENTS

The present invention will be described with reference to the drawings.

Embodiment 1

(1) Example of Image Forming Apparatus

Figure 7:
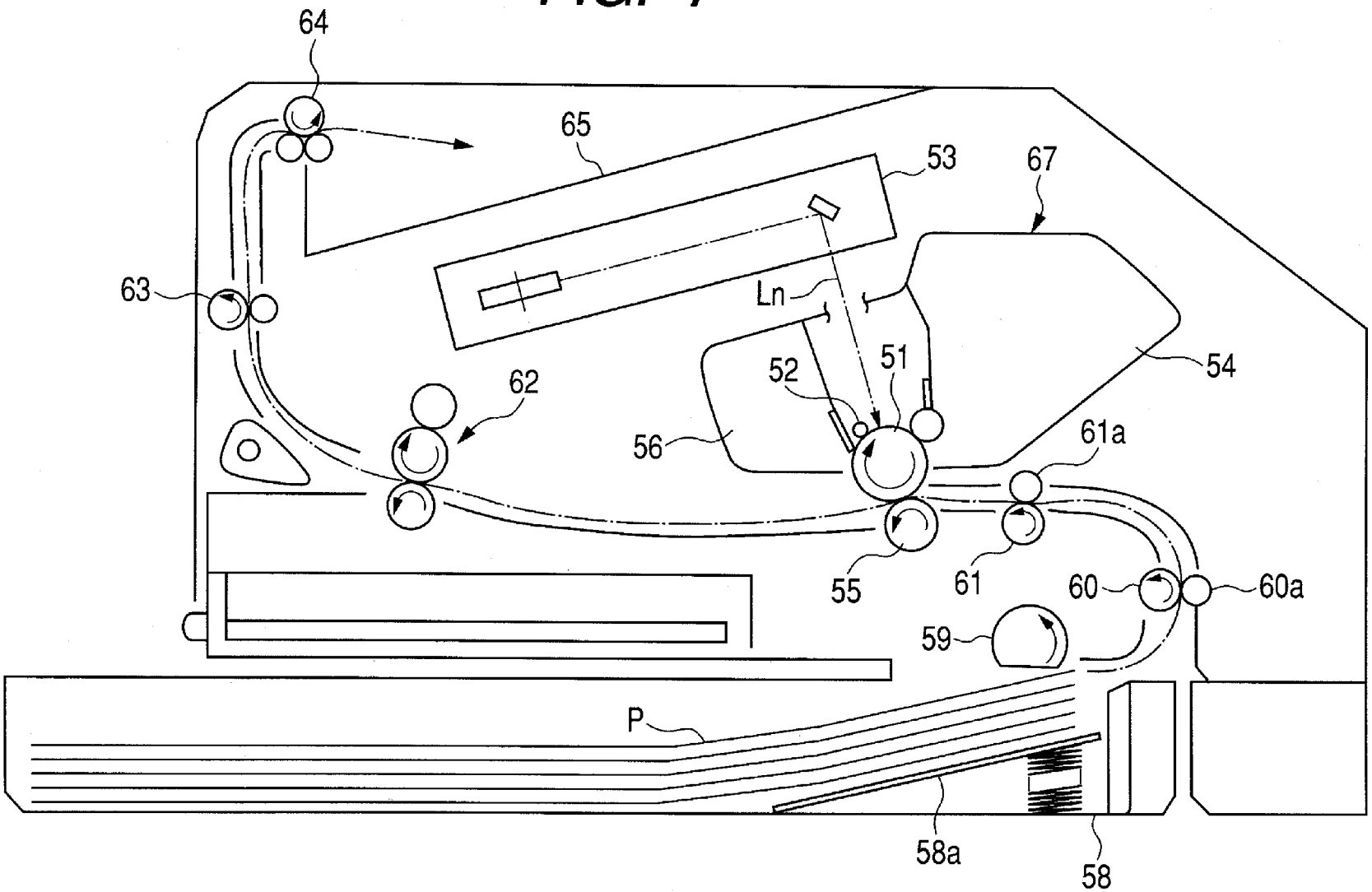
FIG. 7 is a model view of a configuration of an example of an image forming apparatus including the image fixing apparatus.

FIG. 7 is a model view of a configuration of an example of an image forming apparatus including an image fixing apparatus according to the present invention. The image forming apparatus is a laser beam printer using an electrophotographic process.

In an image forming portion, a drum shaped electrophotographic photoreceptor (hereinafter referred to as a photosensitive drum) 51 as an image bearing member is rotated in an arrow direction at a predetermined circumferential velocity (process speed) based on a print signal. An outer peripheral surface (surface) of the photosensitive drum 51 is charged by a charger 52 to uniformly have a predetermined polarity and potential. Then, a laser scanner unit 53 writes image information on a charged surface on the surface of the photosensitive drum 51. The laser scanner unit 53 outputs laser light L modulated according to time-series electric digital pixel signals of image information input by an external apparatus such as a host computer, and uses laser light Ln to scan and expose the charged surface on the surface of the photosensitive drum 51. Thus, an electrostatic latent image (latent image) according to image information is formed on the surface of the photosensitive drum 51. The electrostatic latent image is developed as a toner image (developed image) using toner (developer) by a developing unit 54. The toner image is transferred to a recording material (recording paper) P in a transfer nip portion provided between the photosensitive drum 51 and the transfer roller 55.

The recording materials P are stacked on a stacking table 58*a* of a feed tray 58. The recording materials P are picked up one by one by a feed roller 59 driven at predetermined timing and fed to a resist portion by a conveying roller 60 and a conveying rotatable member 60*a*. In the resist portion, a resist roller 61 and a resist rotatable member 61a feed the recording materials P to the transfer nip portion at predetermined control timing.

The recording material P carrying a toner image transferred in the transfer nip portion is separated from the surface of the photosensitive drum 51 and conveyed to an image fixing apparatus 62. Residual deposit such as transfer residual toner is removed by a cleaner 56 from the surface of the photosensitive drum 51 after separation of the recording material P, and the photosensitive drum 51 is repeatedly used for image formation.

The fixing apparatus 62 heats and fixes, onto the recording material P, an unfixed toner image on the recording material P. The recording material P coming out of the fixing apparatus 62 is delivered through an intermediate delivery roller 63 onto a delivery tray 65 by a delivery roller 64.

The photosensitive drum 51, the charger 52, the developing unit 54, and the cleaner 56 are integrally unitized, and removably mounted, as a process cartridge 67, to a main body of the image forming apparatus.

(2) Fixing Apparatus (Image Fixing Apparatus)

In the following description, for the fixing apparatus and components constituting the fixing apparatus, a longitudinal direction is a direction perpendicular to a recording material conveying direction in a plane of the recording material. A lateral direction is a recording material conveying direction in the plane of the recording material. A length is a size in a direction parallel to the longitudinal direction. A width is a size in a direction parallel to the lateral direction.

Figure 1:
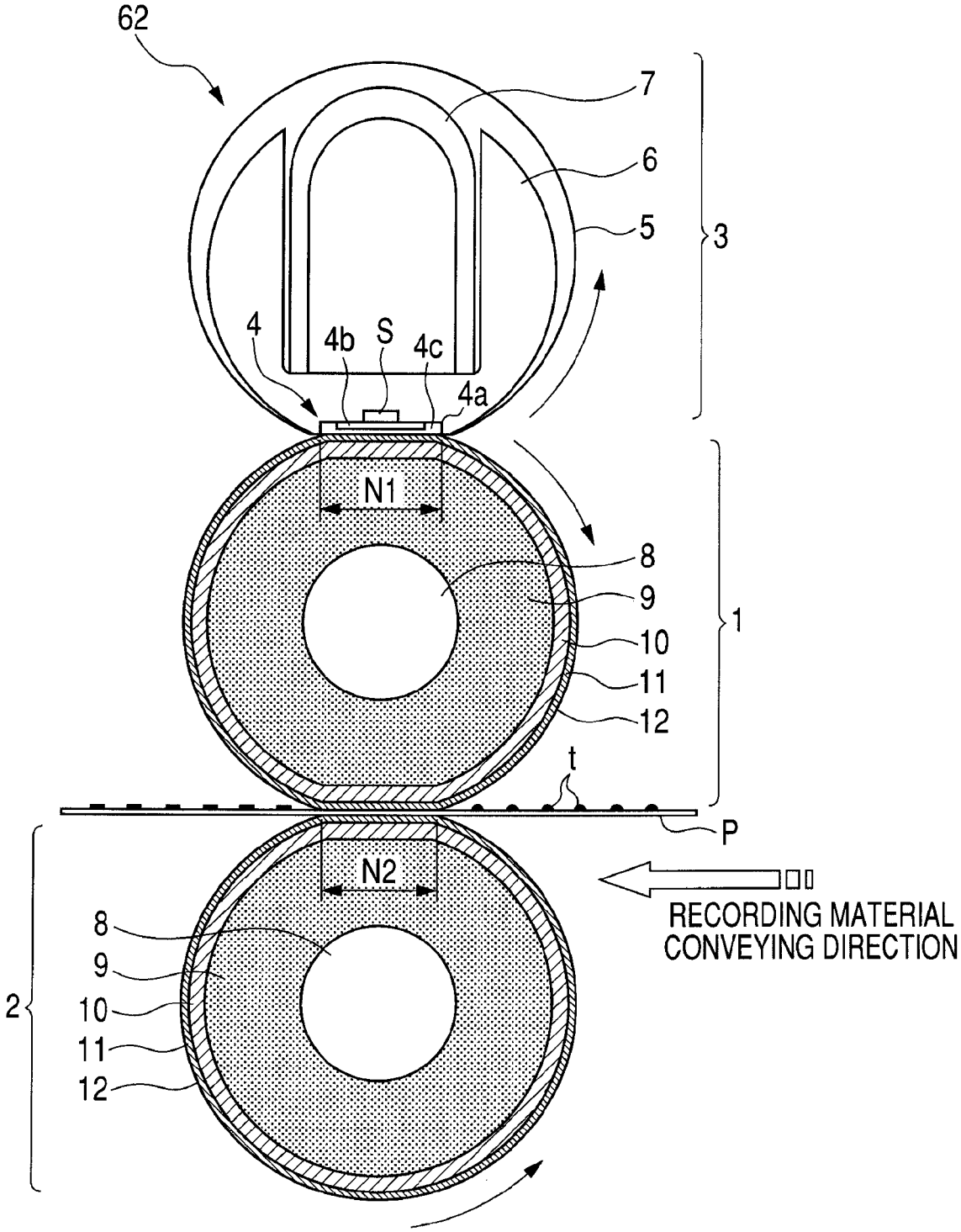
FIG. 1 is a cross sectional side model view of an external heating roller type image fixing apparatus according to Embodiment 1.

FIG. 1 is a cross sectional side model view of an external heating roller type image fixing apparatus 62.

A fixing roller 1 and a pressure roller 2 as rollers for fixing are the same members. In the embodiment, the same components are denoted by the same reference numerals in the fixing roller 1 and the pressure roller 2.

The fixing roller 1 has a core metal 8 of a round shaft, and an elastic layer 9 is formed into a roller shape on the core metal. An intermediate layer 10 is formed on the elastic layer, a thermal conductive fluororubber latex layer 11 is formed on the intermediate layer, and a releasing layer 12 is formed on the thermal conductive fluororubber latex layer as an outermost layer. Specifically, the fixing roller 1 has the thermal conductive fluororubber latex layer more outer side than the elastic layer. In the fixing roller 1, opposite ends of the core metal 8 are rotatably held by an apparatus frame via a bearing (not shown).

The pressure roller 2 has a core metal 8 of a round shaft, and an elastic layer 9 is formed into a roller shape on the core metal. An intermediate layer 10 is formed on the elastic layer, a thermal conductive fluororubber latex layer 11 is formed on the intermediate layer, and a releasing layer 12 is formed on the thermal conductive fluororubber latex layer as an outermost layer. Specifically, the pressure roller 2 has the thermal conductive fluororubber latex layer more outer side than the elastic layer. The pressure roller 2 is placed in parallel with the fixing roller 1, and opposite ends of the core metal 8 are rotatably held by the apparatus frame via a bearing (not shown). A pressure force with total pressure of 98 N (10 kgf) is applied to the core metal 8 of the pressure roller 2 via the bearing by a spring (not shown), and thus an outer peripheral surface (surface) of the pressure roller 2 is brought into pressure contact with an outer peripheral surface (surface) of the fixing roller 1. Thus, the elastic layers 9 and 9 of the pressure roller 2 and the fixing roller 1 are elastically deformed to form a nip portion (fixing nip portion) N2 having a predetermined width between surfaces of the rollers 2 and 1. A length of the nip portion N2 is substantially the same as a maximum width of the recording material P introduced into the fixing apparatus 62.

A heating unit 3 as a heating source includes a heater 4 as a heating source, a holder 6 supporting the heater 4, a sleeve-shaped flexible film 5 externally loosely fitted to an outer periphery of the holder 6, and a rigid stay 7 provided on the holder 6 inside the film 5. To the heating unit 3 placed in parallel with the fixing roller 1, a pressure force with total pressure of 98 N (10 kgf) is applied to the holder 6 held by the apparatus frame via the rigid stay 7 by a spring (not shown). Thus, the heater 4 is brought into pressure contact with the surface of the fixing roller 1 via the film 5. Thus, the elastic layer 9 of the fixing roller 1 is elastically deformed to form a heating nip portion N1 having a predetermined width between an outer peripheral surface of the film 5 and a surface 12 of the fixing roller 1. A length of the heating nip portion N1 is substantially the same as the maximum width of the recording material P introduced into the fixing apparatus 62.

The heater 4 includes a ceramic substrate 4a elongated in a longitudinal direction. On a surface (surface on a side of the heating nip portion N1) of the substrate 4*a*, an energizing heating resistance layer 4*b* is provided along the longitudinal direction of the substrate 4*a*. On the surface of the substrate 4*a*, a power supply electrode (not shown) is provided for supplying power to the energizing heating resistance layer 4*b*. A length of the energizing heating resistance layer 4*b* is substantially the same as the maximum width of the recording material P introduced into the fixing apparatus 62. On the energizing heating resistance layer 4*b*, a protective layer 4*c* that protects the energizing heating resistance layer 4*b* and comes into contact with an inner peripheral surface of the film 5 is provided so as to cover the energizing heating resistance layer 4*b*. A thermistor S as a temperature detection element is abutted against a distant surface of the substrate 4*a* (a surface on the side opposite from the surface on the side of the heating nip portion N1).

The fixing roller 1 is rotatably driven at a predetermined circumferential velocity (process speed) in an arrow direction by torque transferred from a fixing motor (not shown) to a drive gear provided at one end of the core metal 8. With rotation of the fixing roller 1, the pressure roller 2 rotates in an arrow direction substantially at the same circumferential velocity as the circumferential velocity of the fixing roller 1. With the rotation of the fixing roller 1, the film 5 in tight contact with the protective layer 4*c* of the heater 4 rotates around the outer periphery of the holder 6 in an arrow direction substantially at the same circumferential velocity as the circumferential velocity of the fixing roller 1.

In the heater 4, power is supplied from a power supply control circuit (not shown) to the energizing heating resistance layer 4*b* via the power supply electrode and thus the energizing heating resistance layer 4*b* generates heat to rapidly increase temperature. The thermistor S detects the temperature of the heater 4 and outputs the temperature to the power supply control circuit. The power supply control circuit captures an output signal from the thermistor S, and controls the power supply to the energizing heating resistance layer 4*b* based on the output signal to maintain the temperature of the heater 4 at a predetermined fixing temperature (target temperature).

In the rotating fixing roller 1, the surface of the fixing roller 1 is heated from outside the fixing roller 1 via the film 5 by the heater 4 in the heating nip portion N1. Thereby, an amount of heat necessary and sufficient for heating and fixing the unfixed toner image t carried by the recording material P in the nip portion N2.

The recording material P is fed to the fixing apparatus 62 after the toner image is transferred thereto in the image forming portion as described above. The recording material P is introduced into the nip portion N2, held between the surface of the fixing roller 1 and the surface of the pressure roller 2 in the nip portion N2 and conveyed. In the conveying process, the recording material P is heated by the fixing roller 1 and nip pressure is applied thereto in the nip portion N2. Thus, the unfixed toner image t is heated and fixed on the recording material P. The recording material P coming out of the nip portion N2 is separated from the surface of the fixing roller 1 and delivered from the nip portion N2.

(3) Description of Layer Configuration of Fixing Roller (Roller for Fixing)

The fixing roller 1 includes a layer configuration of three types of layers having different functions. A detailed configuration and production method of the fixing roller 1 will be described later. The thermal conductive fluororubber latex layer 11 and the intermediate layer 10 near the surface layer of the fixing roller 1 are formed of a material having higher thermal conductivity than the elastic layer 9 on a more inner side than the intermediate layer 10. Thus, the fixing roller 1 has functions of storing heat from the heater 4 in the thermal conductive fluororubber latex layer (thermal conductive GLS layer) 11 and the intermediate layer 10, and easily emitting heat to the unfixed toner image t on the recording material P.

Specifically, the fixing roller 1 receives heat supplied from the heating unit 3 in the nip portion N1, and stores the heat in the thermal conductive fluororubber latex layer 11 and the intermediate layer 10 near the surface layer. Then, the fixing roller 1 emits heat to the recording material P nipped in the nip portion N2 where the fixing roller 1 comes into pressure contact with the pressure roller 2 and conveyed, and to the unfixed toner image t on the recording material P. Thus, the toner image t can be fixed on the recording paper P by heat and pressure.

The detailed layer configuration and production method of the fixing roller 1 will be described with reference to FIG. 2.

Figure 2:
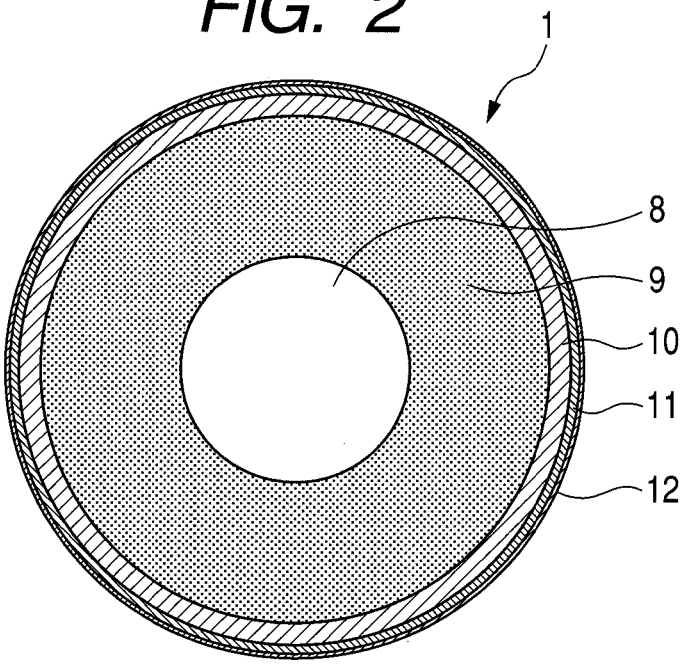
FIG. 2 is a cross sectional side model view of a fixing roller.

FIG. 2 is a cross sectional side model view of the fixing roller 1 as the roller for fixing according to Embodiment 1.

In the fixing roller 1, the core metal 8 has an outer diameter of ϕ12 (mm). The core metal 8 is made of SUS (stainless).

The elastic layer 9 is made of silicone rubber containing a thermal insulation material. Specifically, as the thermal insulation material, the silicone rubber, in which microballoon (microballoon produced by Matsumoto Yushi-Seiyaku Co., Ltd) that is hollow resin filler having a particle size of 50 to 300 μm is dispersed, is used. To form the elastic layer 9 around the core metal 8, primer is first applied to a surface of the core metal 8 and calcined, and then set in a roller outer die. Then, an open-cell foaming agent is blended into silicone rubber containing microballoon, mixed and defoamed, and then the rubber is cast between the core metal and the roller outer die. Further, the rubber is subjected to primary and secondary vulcanization to form the elastic layer 9 having a thickness of 3 t on the core metal 8.

The intermediate layer 10 has a function of preventing wrinkles on the roller surface. The intermediate layer 10 also stores heat in the fixing roller 1.

The heat storing function of the intermediate layer 10 will be described.

The intermediate layer 10 is made of high thermal conductive silicone rubber containing dispersed thermal conductive filler and having thermal conductivity of about 0.85 to 2.2 W/m·K. In the embodiment, the high thermal conductive silicone rubber is diluted with methyl ethyl ketone (MEK) or toluene into a solution, applied onto the thermal insulating elastic layer 9 by spray coating, dried, then subjected to primary and secondary vulcanization and shaped.

The thermal conductive fluororubber latex layer 11 is formed as described below. Alumina is first mixed into fluororubber latex (GLS223F) produced by DAIKIN INDUSTRIES, LTD as thermal conductive filler, a curing agent (GL200B) also produced by DAIKIN INDUSTRIES, LTD is further mixed in an amount of 10% by weight with respect to the weight of GLS223F to prepare dispersion. The dispersion is then applied onto the intermediate layer 10 by spray coating and dried.

The releasing layer 12 is a layer including a fluororesin layer coated on the thermal conductive fluororubber latex layer (hereinafter also referred to as a thermal conductive GLS layer 11). Specifically, the releasing layer 12 is formed by applying PFA (tetrafluoroethylene perfluoro alkylvinylether copolymer) resin dispersion (AD_2CRE produced by DAIKIN INDUSTRIES, LTD) by spray coating, drying, and heating at 320° C. for 15 minutes by an electric oven.

By mixing the thermal conductive filler, the intermediate layer 10 and the thermal conductive GLS layer 11 have thermal conductivity and heat capacity (heat storage performance) as compared with a case without the thermal conductive filler. Thus, the intermediate layer 10 and the thermal conductive GLS layer 11 can efficiently store heat from the external heating unit 3 in the nip portion N1. The thermal insulating elastic layer 9 is provided between the intermediate layer 10 and the core metal 8, and thus the heat stored in the intermediate layer 10 is not released to the core metal 8 but can be efficiently emitted onto the recording paper in the nip portion N2.

The pressure roller 2 as the roller for fixing according to the present invention has completely the same configuration as the fixing roller 1, and thus the description of the pressure roller 2 will be omitted. The pressure roller 2 functions as a backup member for forming a fixing nip portion with the fixing roller 1. Heat from the fixing roller 1 is supplied to the pressure roller 2 when the recording paper is not held in the nip portion N2. Thus, also in the pressure roller 2, the intermediate layer 10 stores heat and emits heat onto the recording paper when the recording paper is held in the nip portion N2. Thus, fixing efficiency of the toner image t on the recording paper can be increased as compared with a case where a pressure roller without an intermediate layer 10, that is, a pressure roller without heat storage performance is used. It is not always necessary to use a roller having the same structure as the fixing roller 1 as the backup member for forming the fixing nip portion N2 with the fixing roller 1. A nonrotatable pad-shaped backup member may be used rather than the roller-shaped backup member.

The thickness of the thermal conductive GLS layer 11 needs to be 30 μm or less. With a thickness larger than 30 μm, it becomes useless to mix the filler for increasing thermal conductivity of the GLS layer 11.

The thermal conductivity of the thermal conductive GLS layer 11 can be increased with increasing amount of filler, but a film forming property is reduced with increasing content of the filler. Thus, thermal conductivity of 0.65 W/m·K maximum is the limit. Thermal conductivity of GLS without any thermal conductive filler (hereinafter referred to as pure GLS) is about 0.16 W/m·K.

Generally, a minimum thickness of a film-forming of a pure GLS film is about 8 μm also in view of mass productivity. With a thickness smaller than 8 μm, leveling after coating is difficult, and a stable thickness and surface property cannot be obtained. The thickness of the thermal conductive GLS layer 11, having thermal conductivity of 0.65 W/m·K and having heat permeability comparable to the pure GLS with the minimum thickness, is 30 μm.

Thus, for the thermal conductive GLS layer 11 to obtain at least a higher thermal effect than the pure GLS layer of 8 μm which does not contain thermal conductive filler and is thus inexpensive, the thickness needs to be smaller than 30 μm.

Generally, with increasing thickness of the releasing layer 12 in the embodiment, cracks occur more easily during drying after application of fluororesin dispersion by spray coating.

A fluororesin layer having a thickness larger than 15 μm can be formed by application of dispersion by spray coating. However, repeated application and drying is required, and thus a post process such as drying is more than once and further added to increase processes and increase cost.

Increasing the thickness of the releasing layer 12 of the pure fluororesin layer having low thermal conductivity reduces thermal advantages due to providing the intermediate layer 10 having higher thermal conductivity than the thermal conductive GLS layer 11 on the elastic layer 9 and providing thermal conductivity to the thermal conductive GLS layer 11. In this sense, it is useless to increase the thickness of the releasing layer 12 to be larger than 15 μm. PFA (tetrafluoroethylene perfluoro alkylvinylether copolymer) without thermal conductive filler for increasing thermal conductivity mixed in fluororesin is hereinafter referred to as pure PFA.

This tendency also applies to general fluororesin dispersion. In the embodiment, pure PFA is particularly used as fluororesin for the releasing layer 12. However, fluororesin other than PFA, for example, PTFE (polytetrafluoroethylene) or FEP (tetrafluoroethylene hexafluoropropylene copolymer) basically has substantially the same thermal conductivity as PFA, and has substantially the same upper limit of maximum coating thickness.

Figure 3:
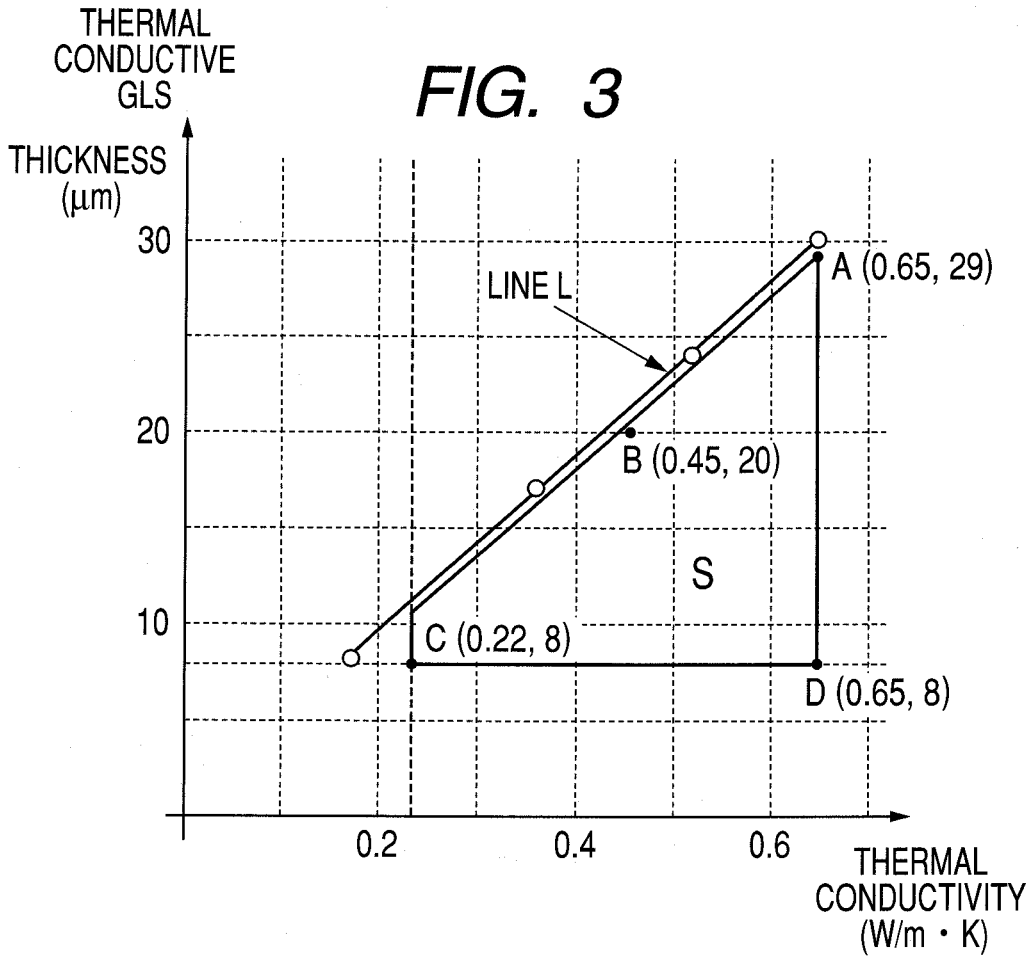
FIG. 3 illustrates a region of possible thermal conductivity and thickness of a thermal conductive GLS layer.

Results of examining possible maximum thicknesses (thicknesses for heat permeability comparable to the pure GLS layer with the thickness of 8 μm), when the thermal conductivity of the thermal conductive GLS layer 11 is changed, are illustrated by a line L in FIG. 3. Meanwhile, a possible minimum thickness of the thermal conductive GLS layer 11 is 8 μm. Coating of less than 8 μm inhibits leveling after spray coating, thereby a uniform film is inhibited from being formed. Thus, possible thermal conductivity and thickness of the thermal conductive GLS layer 11 in the embodiment is limited within a region S in FIG. 3.

Before describing the configuration for preventing wrinkles on the roller surface, the reason will be described why wrinkles easily occur on the roller surface during production of the fixing roller 1 and the pressure roller 2 using the thermal conductive GLS layer 11 containing the thermal conductive filler.

(Concerning Occurrence Mechanism of Wrinkles on Roller Surface)

Generally, a roller including a thermal conductive fluororubber latex layer is produced by calcining at a temperature of more than 300° C., desirably 320° C. to 330° C. so that seepage and leveling of fluororesin in the thermal conductive fluororubber latex layer are performed at 300° C. or higher. Wrinkles on the roller surface occur during cooling after the calcining.

In the production process of the roller, both the thermal conductive GLS layer 11 and the intermediate layer 10 shrink during the cooling, but the intermediate layer 10 has a higher expansion coefficient and thus shrinks more significantly. This is because the thermal conductive GLS layer 11 includes a mixture of fluororubber and fluororesin. Particularly, shrinkage occurs because the property of the fluororesin having a lower expansion coefficient is dominant.

The difference in shrinkage causes stress to be easily accumulated between the intermediate layer 10 and the thermal conductive GLS layer 11. However, this tendency changes at a phase transition temperature Tg° C. of fluororesin in the thermal conductive GLS layer 11.

Figure 4A:
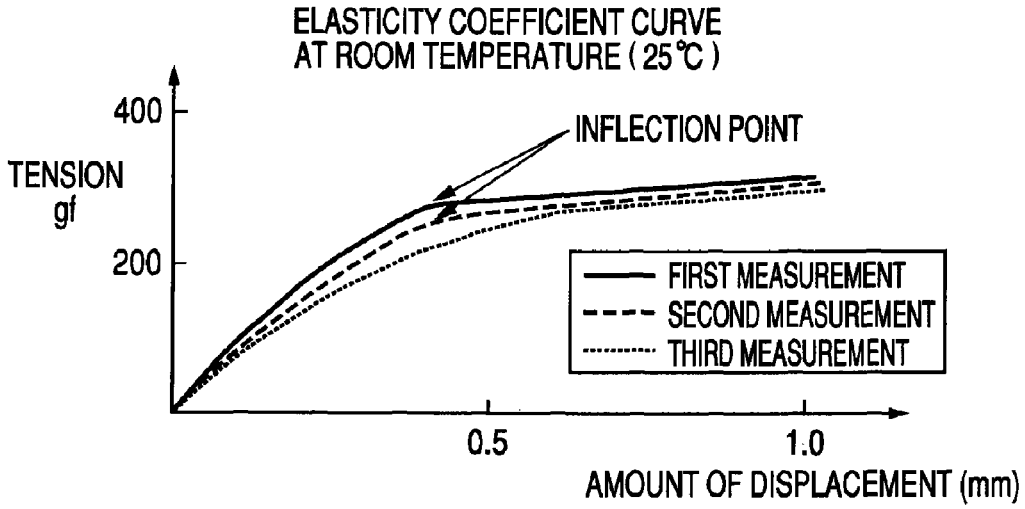
FIGS. 4A, 4B and 4C illustrate changes in elasticity coefficient curve of a pure GLS layer when temperature is changed.
Figure 4B:
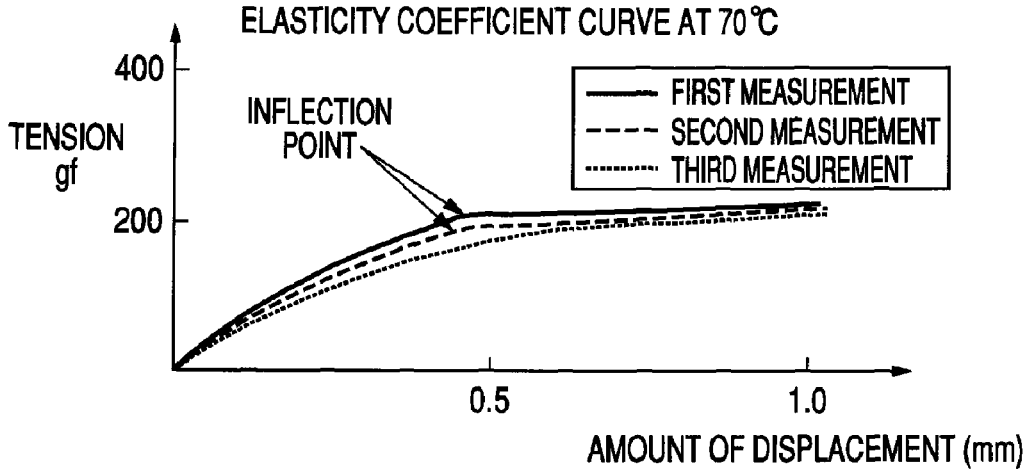
Figure 4C:
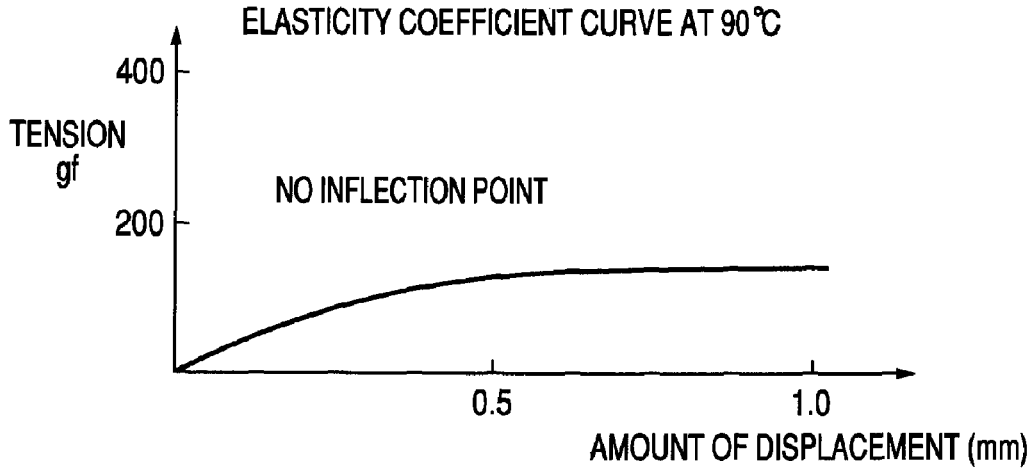

FIGS. 4A to 4C illustrate changes in elasticity coefficient curve of a pure GLS layer when temperature is changed.

The phase transition temperature Tg will be described with reference to FIGS. 4A to 4C.

The elasticity coefficient curve was measured by actually forming GLS223F used in the embodiment into a film having a thickness of 60 μm as a test piece, and using a solid rheometer (E4000).

FIG. 4A illustrates an elasticity coefficient curve of the test piece of the GLS223F film at around a room temperature (25° C.). There is an inflection point in the elasticity coefficient curve in FIG. 4A. The inflection point has an irreversible feature of gradually disappearing when the same sample is repeatedly measured, and indicates a yield point of elasticity of fluororesin component in GLS.

FIGS. 4B and 4C illustrate elasticity coefficient curves of the test piece when the temperature is increased to 70° C. and 90° C., respectively. When the temperature is increased, the inflection point is disappearing and completely disappears at 90° C.

At the temperature at which the inflection point disappears, the elasticity coefficient curve has a reversible feature of being located on the same curve even when the sample is repeatedly measured. Thus, it is determined that the GLS layer changes to a phase where reversible elasticity, that is, rubber elasticity is dominant at the temperature where the inflection point disappears, and the temperature where the inflection point disappears is defined as a phase transition temperature Tg. For the GLS223F with PFA resin used in the embodiment, the phase transition temperature Tg is 90° C. However, the value generally changes depending on difference of the kinds of fluororesin in a GLS layer.

FIGS. 5A to 5E illustrate an occurrence mechanism of roller surface wrinkles during production of the roller. The process is illustrated of gradual cooling after calcining the fluororubber latex layer at a temperature of 320 to 330° C.

Figure 5A:
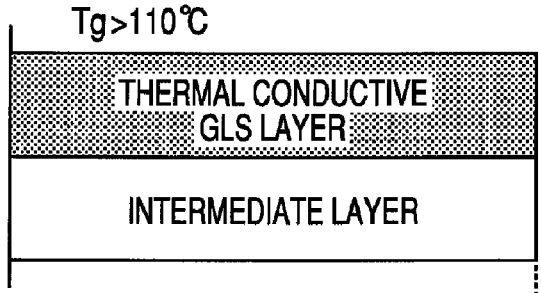
FIGS. 5A, 5B, 5C, 5D and 5E illustrate an occurrence mechanism of roller surface wrinkles during production of the roller.
Figure 5B:
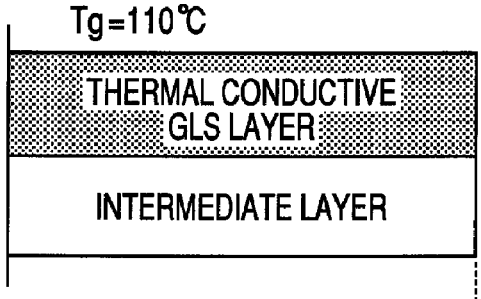
Figure 5C:
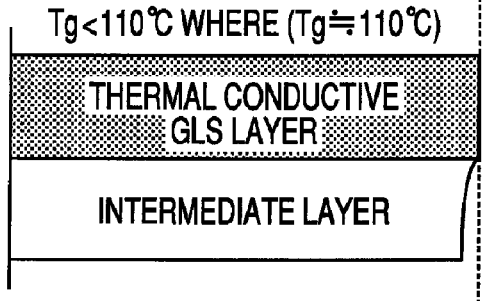

As described above, when the thermal conductive GLS layer 11 is at the phase transition temperature Tg° C.(=90° C.) or higher, the thermal conductive GLS layer 11 is in the state where the rubber elasticity is dominant, and thus easily follows shrinkage of the intermediate layer 10 and is hard to accumulate distortion (see FIG. 5A).

However, when the surface temperature of the roller is lower than the phase transition temperature (90° C.) of PFA that is fluororesin of the thermal conductive GLS layer 11 in the embodiment, then the thermal conductive GLS layer 11 enters a state where the elasticity of PFA is not the rubber elasticity (a state with limited deformation or movement of molecules). Thus, stress due to the difference in expansion coefficient is accumulated between the thermal conductive GLS layer 11 and the intermediate layer 10 (see FIG. 5C). The stress increases as the temperature of the roller is lower from the phase transition temperature Tg° C.

Figure 5D:
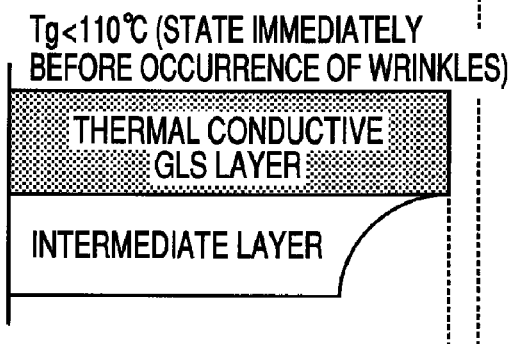
Figure 5E:
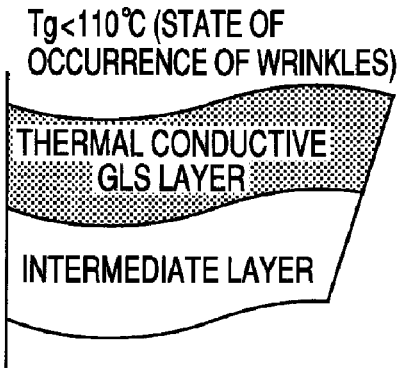

With a little stress, the thermal conductive GLS layer 11 stands against a significant shrinking force of the intermediate layer 10 so as not to be folded (so as not to generate wrinkles), and thus the wrinkles do not occur (see FIG. 5D). However, when the cooling advances and much stress is accumulated, the shrinking force of the intermediate layer 10 deforms the high thermal conductive GLS layer 11 and the intermediate layer 10 to generate wrinkles (see FIG. 5E).

Further, as more thermal conductive filler is mixed in the thermal conductive GLS layer 11, the rubber elasticity of the thermal conductive GLS layer 11 is reduced and the stress is easily directly accumulated, and thus wrinkles easily occur on the roller surface during production of the roller. This tendency is particularly noticeable when a volume fraction of thermal conductive filler in the thermal conductive GLS layer 11 is 5 vol % or more irrespective of the kinds of thermal conductive filler because rubber elasticity is reduced. Specifically, the thermal conductive GLS layer 11 contains thermal conductive filler at a volume fraction of 5% or more. The volume fraction is defined by the following equation:

$$Vf/Vt = \text{volume fraction}$$

where Vf is a total volume of filler in a unit volume of the GLS layer 11 and Vt is a unit volume of the GLS layer 11). In short, the wrinkles on the roller surface during production occur resulting from the fact that the stress due to that the difference in thermal expansion coefficient between the thermal conductive GLS layer 11 and the intermediate layer 10 deforms the thermal conductive GLS layer 11 and the intermediate layer 10. Thus, the wrinkles are prevented from occurring on the roller surface during production, when elasticity of the intermediate layer 10 is increased so as to prevent deformation of the intermediate layer 10.

The intermediate layer 10 made of high thermal conductive silicone rubber can be easily and significantly increased in rigidity, thereby effectively preventing wrinkles from occurring.

An effect of preventing wrinkles from occurring on the roller surface during production actually obtained by increasing elasticity of the intermediate layer 10 in the embodiment will be described. As the thermal conductive GLS layer 11 of the fixing roller 1 of the embodiment, the following two types of GLS layers GL(i) and GL(ii) are evaluated.

GL(i) is formed to have an alumina content of 28 vol %, thermal conductivity of about 0.45 W/m·K, and a thickness of 20 μm, with a releasing layer 12 formed of pure PFA resin (AD_2CRE produced by DAIKIN INDUSTRIES, LTD) to have a thickness of 15 μm.

GL(ii) is formed to have an alumina content of 36 vol %, thermal conductivity of about 0.65 W/m·K, and a thickness of 8 μm, with a releasing layer 12 formed of pure PFA resin (AD_2CRE produced by DAIKIN INDUSTRIES, LTD) to have a thickness of 5 μm.

GL(i) corresponds to a point B and GL(ii) corresponds to a point D in FIG. 3.

The elasticity increases, when an elastic parameter Y (Y=H×T) satisfies the following relational expression (1):

$$Y \geqq 4200 \qquad \text{Relational expression (1)}$$

where H (degree) is Asker-C hardness (500 g load) of high thermal conductive silicone rubber of the intermediate layer 10 and T (μm) is a thickness of the intermediate layer 10.

For describing the effect of the configuration, the results are shown of occurrence status of the roller surface wrinkles during production of the roller when the configuration of the intermediate layer 10 is changed to change the elastic parameter Y.

Table 1 below shows relationships between elastic parameters Y and occurrence of roller surface wrinkles when high thermal conductive silicone rubber (hereinafter also referred to as rubber material) of the intermediate layer 10 is changed.

In Table 1, results of comparison with rollers formed to all include the intermediate layer 10 having a thickness T of 100

μm are shown for easy comparison of curing depending on differences in hardness of rubber material.

TABLE 1

| | Kind of rubber | Asker-C hardness (Degree) | Elastic parameter Y | Occurrence of roller surface wrinkles (GL(i)) | Occurrence of roller surface wrinkles (GL(ii)) |
|---|---|---|---|---|---|
| (i) | Rubber A | 19 | 1900 | Yes | Yes |
| (ii) | Rubber B | 24 | 2400 | Yes | Yes |
| (iii) | Rubber C | 31 | 3100 | Yes | Yes |
| (iv) | Rubber C (B agent 150%) | 36 | 3600 | Yes | Yes |
| (v) | Rubber D | 40 | 4000 | Slightly Yes | Slightly Yes |
| (vi) | Rubber C (B agent 200%) | 42 | 4200 | No | No |
| (vii) | Rubber E | 56 | 5600 | No | No |
| (viii) | Rubber F | 90 | 9000 | No | No |

Table 1) Comparison of occurrence of roller surface wrinkles with intermediate layer having thickness of 100 μm and rubber material changed In Table 1, for the formed rollers, six kinds of high thermal conductive silicone rubber are compared. Rubber C in Table 1 is an addition and two-liquid mixed type silicone rubber, and an A agent containing a polymer and a catalyst and a B agent containing a polymer and a curing agent are mixed and heated, and thus cured. A mixing ratio of the A agent and the B agent is generally 1:1, but the ratio of the B agent can be increased to increase rubber hardness after curing. Specifically, with the rubber C, rollers are also formed at mixing ratios with an increased amount of the B agent as the curing agent, that is, 1:1.5 (B agent 150%) and 1:2 (B agent 200%) for examination with greater variations of the intermediate layer with different hardness. The values of Asker-C hardness as rubber hardness in Table 1 are all measured for rubber after secondary vulcanization.

The results in Table 1 reveal that hard high thermal conductive silicone rubber with the elastic parameter Y of 4200 or more (satisfying the relational expression (1)) of the intermediate layer 10 is used to prevent roller surface wrinkles from occurring during production. Next, the results of examining occurrence of the roller surface wrinkles during production of the roller when the thickness of the intermediate layer 10 is changed to change the elastic parameter Y are shown in Table 2.

Table 2) Results of comparison of occurrence of roller surface wrinkles with thickness of intermediate layer changed The results in Table 2 reveal that even for rubber (rubber A) with wrinkles at a thickness of 100 μm, the thickness is increased so that the elastic parameter Y satisfies the relational expression (1) to prevent the roller surface wrinkles from occurring during production of the roller. On the other hand, the results reveal that even for rubber (rubber C (B agent 200%)) without wrinkles at a thickness of 100 μm, the thickness is reduced so that the elastic parameter Y does not satisfy the relational expression (1) to cause the roller surface wrinkles to occur during production of the roller.

Examinations are also conducted with the thickness of the releasing layer 12 being set to the maximum of 15 μm and with the thermal conductivity and thickness of the thermal conductive GLS layer 11 being set to the same at points A (0.65, 29) and C (0.22, 8) in the region S in FIG. 3. The results are the same at the points B(GL(i)) and D(GL(ii)), and since the elastic parameter Y is set so as to satisfy the relational expression (1), wrinkles do not occur.

An outer diameter expansion coefficient of the roller this time is 2% at 90° C. that is the phase transition temperature Tg of PFA in the GLS layer. The outer diameter expansion coefficient of the roller is hereinafter an expansion coefficient(= (ϕ(Tg) mm−ϕ(25) mm)/ϕ(25) mm) of the roller outer diameter at the phase transition temperature Tg with respect to the roller outer diameter at room temperature (25° C.). ϕ(Tg) mm and ϕ(25) mm are those of the roller outer diameter at the phase transition temperature Tg and the room temperature (25° C.). The same results are obtained when an amount of a resin balloon open-cell foaming agent in a base layer rubber is increased to facilitate open-cell foaming and to reduce the outer diameter expansion coefficient of the roller to 0.8% (ϕ(Tg) mm/ϕ(25) mm≧1.008). The base layer is the elastic layer 9. For the roller having an outer diameter expansion coefficient of 0.7% or less, wrinkles do not occur during production of the roller.

According to the fixing roller 1 and the pressure roller 2 of the embodiment, the elastic parameter Y of the intermediate layer 10 is set so as to satisfy the relational expression (1), thereby preventing deformation of the intermediate layer 10 and the thermal conductive GLS layer 11 when a force to generate wrinkles is applied during production of the roller (cooling process after calcining). Thus, occurrence of the wrinkles on the roller surface is prevented during production of the roller.

TABLE 2

| | Kind of rubber | Asker-C hardness (Degree) | Thickness (μm) | Elastic parameter Y | Occurrence of roller surface wrinkles (GL(i)) | Occurrence of roller surface wrinkles (GL(ii)) |
|---|---|---|---|---|---|---|
| (i) | Rubber A | 19 | 100 | 1900 | Yes | Yes |
| (ii) | " | 19 | 210 | 3990 | Slightly Yes | Slightly Yes |
| (iii) | " | 19 | 230 | 4370 | No | No |
| (iv) | Rubber C (B agent 200%) | 42 | 80 | 3360 | Yes | Yes |
| (v) | Rubber C (B agent 200%) | 42 | 100 | 4200 | No | No |
| (vi) | Rubber C (B agent 200%) | 42 | 120 | 5040 | No | No |

According to the image fixing apparatus of the embodiment, the fixing roller 1 and the pressure roller 2 each include the thermal conductive GLS layer 11 and the intermediate layer 10 having thermal conductivity and heat capacity (heat storage performance), and thus can efficiency store heat and smoothly emit the stored heat onto the recording paper P. This can increase fixing efficiency of the unfixed toner image t on the recording paper P. Also, the heat can be efficiently stored, thereby reducing fixing temperature and electric power supplied to the heater 4. The wrinkles on the surface of the fixing roller can be prevented though filler for increasing thermal conductivity is mixed in the fluororubber latex.

Embodiment 2

In Embodiment 1, the example in which the roller for fixing is used as the fixing roller and the pressure roller of the external heating roller type image fixing apparatus 62 is described. The roller for fixing is not limited thereto, but can be used as a pressure roller of a film heating type image fixing apparatus (see FIG. 6).

Figure 6:
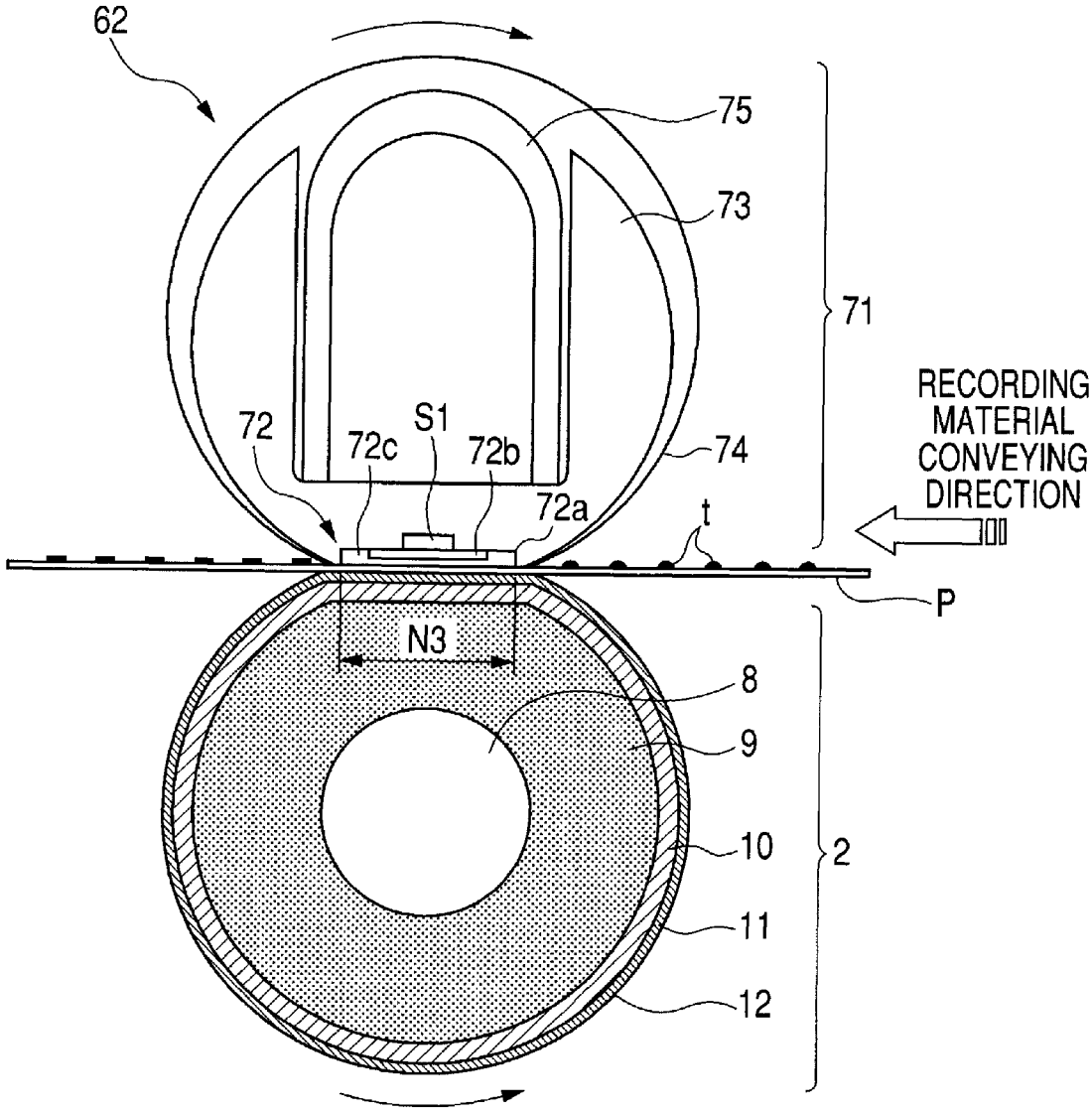
FIG. 6 is a cross sectional side model view of an example of a film heating type image fixing apparatus according to Embodiment 2.

FIG. 6 is a cross sectional side model view of an example of a film heating type image fixing apparatus 62 using a roller for fixing as a pressure roller.

A film unit 71 includes a heater 72 as a heating source and a holder 73 supporting the heater 72. A sleeve-shaped flexible film (endless belt) 74 as a flexible member is externally loosely fitted to an outer periphery of the holder 73. A rigid stay 75 is provided on the holder 6 inside the film 74.

A pressure roller 2 is placed in parallel with the film unit 71, and opposite ends of a core metal 8 are rotatably held by an apparatus frame via a bearing (not shown). A predetermined pressure force is applied to the core metal 8 of the pressure roller 2 via the bearing by a spring (not shown), and thus a surface of the pressure roller 2 is pressed by the heater 72 via the film 74. Thus, an elastic layer 9 of the pressure roller 2 is elastically deformed to form a nip portion (fixing nip portion) N3 having a predetermined width between an outer peripheral surface (surface) of the film 74 and the surface of the pressure roller 2. A length of the nip portion N3 is substantially the same as a maximum width of the recording material P introduced into the fixing apparatus 62.

The heater 72 includes a ceramic substrate 72*a* elongated in a longitudinal direction, an energizing heating resistance layer 72*b*, a power supply electrode (not shown), and a protective layer 72*c*, like the heater 4 in the external heating roller type fixing apparatus 62. A length of the energizing heating resistance layer 72*b* is substantially the same as the maximum width of a recording material P introduced into the fixing apparatus 62.

The pressure roller 2 is rotatably driven at a predetermined circumferential velocity (process speed) in an arrow direction by torque transferred from a fixing motor (not shown) to a drive gear provided at one end of the core metal 8. With rotation of the pressure roller 2, the film 74 rotates in an arrow direction substantially at the same circumferential velocity as the circumferential velocity of the pressure roller 2.

In the heater 72, power is supplied from a power supply control circuit (not shown) to the energizing heating resistance layer 72*b* via the power supply electrode and thus the energizing heating resistance layer 72*b* generates heat to rapidly increase temperature. A thermistor S1 provided on the substrate 72*a* of the heater 72 detects the temperature of the heater 72 and outputs the temperature to the power supply control circuit. The power supply control circuit captures an output signal from the thermistor S1, and controls the power supply to the energizing heating resistance layer 72*b* based on the output signal to maintain the temperature of the heater 72 at a predetermined fixing temperature (target temperature).

The inner peripheral surface (inner surface) of the rotating film 74 is heated by the heater 72 in the nip portion N3. This provides an amount of heat necessary and sufficient for heating and fixing an unfixed toner image t carried by the recording material P in the nip portion N3.

The recording material P carrying the unfixed toner image t is introduced into the nip portion N3, held between the surface of the film 74 and the surface of the pressure roller 2 in the nip portion N3 and conveyed. In the pinching and conveying process of the recording material P, the recording material P is heated via the film 74 by the heater 72 and nip pressure is applied thereto in the nip portion N2. Thus, the toner image t is heated and fixed on the recording material P. The recording material P coming out of the nip portion N3 is separated from the surface of the pressure roller 2 and delivered from the nip portion N3.

According to the film heating type image fixing apparatus of Embodiment 2, the pressure roller 2 includes the thermal conductive GLS layer 11 and the intermediate layer 10 having thermal conductivity and heat capacity (heat storage performance), and thus can efficiency store heat and smoothly emit the stored heat onto the recording paper P. This can increase fixing efficiency of the unfixed toner image t on the recording paper P. Also, the heat can be efficiently stored, thereby reducing fixing temperature and electric power supplied to the heater 72. Wrinkles on the surface of the pressure roller can be prevented though filler for increasing thermal conductivity is mixed in the fluororubber latex.

It is to be understood that the roller outer diameter and the core metal diameter of the fixing roller 1 are not limited to those in Embodiment 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-125488, filed May 13, 2008, which is hereby incorporated by reference herein in its entirety.

What is claimed is:

1. A roller for fixing comprising:

a core metal;

an elastic layer;

a fluororubber latex layer; and an intermediate layer provided between the elastic layer and the fluororubber latex layer and having thermal conductivity higher than thermal conductivity of the elastic layer, wherein the fluororubber latex layer includes fillers for increasing thermal conductivity, and an elastic parameter Y(=H×T) satisfies a relational expression:

$$Y \geqq 4200$$

where H (degree) is Asker-C hardness of the intermediate layer (500 g load) and T (μm) is a thickness of the intermediate layer.

2. The roller for fixing according to claim 1, wherein when an outer diameter of the roller for fixing at 25° C. is $\phi(25)$ mm, and the outer diameter of the roller for fixing at a phase transition temperature Tg° C. of fluororesin in the fluororubber latex layer is $\phi(Tg)$ mm, $\phi(Tg)/\phi(25) \geqq 1.008$.

3. The roller for fixing according to claim 1, wherein the fluororubber latex layer contains the filler in a volume fraction of 5% or more.

4. The roller for fixing according to claim 1, wherein the roller for fixing further includes a fluororesin layer coated on the fluororubber latex layer.

5. An image fixing apparatus for heating a recording material carrying a toner image and heating and fixing the toner image on the recording material, comprising:

a roller for fixing including a core metal, an elastic layer, a fluororubber latex layer, and an intermediate layer which is provided between the elastic layer and the fluororubber latex layer and which has thermal conductivity higher than thermal conductivity of the elastic layer;

a heater for heating the roller for fixing from outside;

a backup member for forming, with the roller for fixing, a fixing nip portion for pinching and conveying the recording material, wherein the fluororubber latex layer includes fillers for increasing thermal conductivity, and an elastic parameter Y(=H×T) satisfies a relational expression:

$$Y \geqq 4200$$

where H (degree) is Asker-C hardness of the intermediate layer (500 g load) and T (μm) is a thickness of the intermediate layer.

6. The image fixing apparatus according to claim 5, wherein when an outer diameter of the roller for fixing at 25° C. is ϕ(25) mm, and the outer diameter of the roller for fixing at a phase transition temperature Tg° C. of fluororesin in the fluororubber latex layer is ϕ(Tg) mm, ϕ(Tg)/ϕ(25)≧1.008.

7. The image fixing apparatus according to claim 5, wherein the fluororubber latex layer contains the filler in a volume fraction of 5% or more.

8. The image fixing apparatus according to claim 5, wherein the roller for fixing further includes a fluororesin layer coated on the fluororubber latex layer.

9. An image fixing apparatus for heating a recording material carrying a toner image and heating and fixing the toner image on the recording material, comprising:

an endless belt;

a heater that comes into contact with an inner surface of the endless belt;

a roller for fixing for forming, with the heater, a fixing nip portion which pinches and conveys the recording material via the endless belt, the roller for fixing including a core metal, an elastic layer, a fluororubber latex layer, and an intermediate layer which is provided between the elastic layer and the fluororubber latex layer and which has thermal conductivity higher than thermal conductivity of the elastic layer, wherein the fluororubber latex layer includes fillers for increasing thermal conductivity, and an elastic parameter Y(=H×T) satisfies a relational expression:

$$Y \geqq 4200$$

where H (degree) is Asker-C hardness of the intermediate layer (500 g load) and T (μm) is a thickness of the intermediate layer.

10. The image fixing apparatus according to claim 9, wherein when an outer diameter of the roller for fixing at 25° C. is ϕ(25) mm, and the outer diameter of the roller for fixing at a phase transition temperature Tg° C. of fluororesin in the fluororubber latex layer is ϕ(Tg) mm, ϕ(Tg)/ϕ(25)≧1.008.

11. The image fixing apparatus according to claim 9, wherein the fluororubber latex layer contains the filler in a volume fraction of 5% or more.

12. The image fixing apparatus according to claim 9, wherein the roller for fixing further includes a fluororesin layer coated on the fluororubber latex layer.

* * * * *